US011473808B2

(12) United States Patent
Tsuchida

(10) Patent No.: US 11,473,808 B2
(45) Date of Patent: Oct. 18, 2022

(54) AIR-CONDITIONING APPARATUS

(71) Applicant: Mitsubishi Electric Corporation, Tokyo (JP)

(72) Inventor: Yuki Tsuchida, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/272,789

(22) PCT Filed: Nov. 8, 2018

(86) PCT No.: PCT/JP2018/041477
§ 371 (c)(1),
(2) Date: Mar. 2, 2021

(87) PCT Pub. No.: WO2020/095406
PCT Pub. Date: May 14, 2020

(65) Prior Publication Data

US 2021/0215381 A1 Jul. 15, 2021

(51) Int. Cl.
*F24F 11/79* (2018.01)

(52) U.S. Cl.
CPC ..... *F24F 11/79* (2018.01)

(58) Field of Classification Search
CPC .. F24F 11/79; F24F 11/745; F24F 3/02; F24F 3/04; F24F 2110/40
See application file for complete search history.

(56) References Cited

U.S. PATENT DOCUMENTS 5,863,246 A * 1/1999 Bujak, Jr. ..... F24F 11/70 454/238
2003/0104778 A1* 6/2003 Liu ..... F24F 11/0001 454/61
2006/0116067 A1* 6/2006 Federspiel ..... F24F 11/0001 454/256
2011/0053488 A1* 3/2011 Gans ..... F23L 17/005 454/343

(Continued)

FOREIGN PATENT DOCUMENTS

JP H03-051658 A 3/1991
JP 5404777 B2 2/2014
JP 2016-156573 A 9/2016

(Continued)

OTHER PUBLICATIONS

International Search Report of the International Searching Authority dated Feb. 5, 2019 for the corresponding International application No. PCT/JP2018/041477 (and English translation).

(Continued)

*Primary Examiner* — Nelson J Nieves
(74) *Attorney, Agent, or Firm* — Posz Law Group, PLC

(57) ABSTRACT

An air-conditioning apparatus includes a fan configured to send air to an air-conditioned space, a fan motor configured to drive the fan, a duct having a plurality of air outlets, the air sent by the fan flowing through the duct, a detection unit configured to detect an air flow rate of the fan, a damper provided to each of the plurality of air outlets, and a fan motor control unit configured to control a rotation speed of the fan motor such that the air flow rate assumes a constant value relative to variations in an opening degree of the damper of a plurality of dampers.

7 Claims, 10 Drawing Sheets

(56) References Cited

U.S. PATENT DOCUMENTS

2012/0037714 A1 2/2012 Tsutsumi

FOREIGN PATENT DOCUMENTS

WO 2010131336 A1 11/2010
WO 2016/092635 A1 6/2016

OTHER PUBLICATIONS

Office Action dated Nov. 30, 2021, issued in corresponding JP Patent Application No. 2020-556425 (and English Machine Translation).
Examination Report dated Mar. 23, 2022 issued in corresponding GB patent application No. 2106106.4.

* cited by examiner

FIG. 5

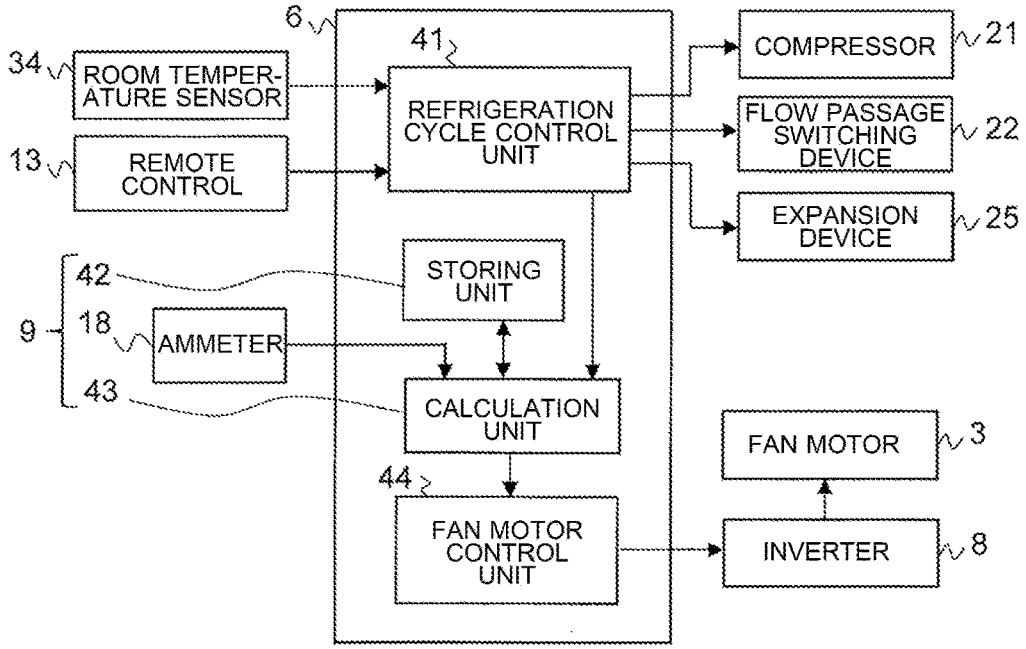

FIG. 6

| DESIGNATED FREQUENCY F | SECONDARY CURRENT I | AIR FLOW Q | REMARKS | |
|---|---|---|---|---|
| $F_0$ | $I_{0-0} \leqq I < I_{0-1}$ | $Q_{01}$ | $Q_{01} = (Q_0 + Q_1)/2$ | $Q_0 \leqq Q_{01} < Q_1$ |
| | $I_{0-1} \leqq I < I_{0-2}$ | $Q_{12}$ | $Q_{12} = (Q_1 + Q_2)/2$ | $Q_1 \leqq Q_{12} < Q_2$ |
| | $I_{0-2} \leqq I < I_{0-3}$ | $Q_{23}$ | $Q_{23} = (Q_2 + Q_3)/2$ | $Q_2 \leqq Q_{23} < Q_3$ |
| | $I_{0-3} \leqq I < I_{0-4}$ | $Q_{34}$ | $Q_{34} = (Q_3 + Q_4)/2$ | $Q_3 \leqq Q_{34} < Q_4$ |
| | $I_{0-4} \leqq I < I_{0-5}$ | $Q_{45}$ | $Q_{45} = (Q_4 + Q_5)/2$ | $Q_4 \leqq Q_{45} < Q_5$ |
| $F_1$ | $I_{1-0} \leqq I < I_{1-1}$ | $Q_{01}$ | $Q_{01} = (Q_0 + Q_1)/2$ | $Q_0 \leqq Q_{01} < Q_1$ |
| | $I_{1-1} \leqq I < I_{1-2}$ | $Q_{12}$ | $Q_{12} = (Q_1 + Q_2)/2$ | $Q_1 \leqq Q_{12} < Q_2$ |
| | $I_{1-2} \leqq I < I_{1-3}$ | $Q_{23}$ | $Q_{23} = (Q_2 + Q_3)/2$ | $Q_2 \leqq Q_{23} < Q_3$ |
| | $I_{1-3} \leqq I < I_{1-4}$ | $Q_{34}$ | $Q_{34} = (Q_3 + Q_4)/2$ | $Q_3 \leqq Q_{34} < Q_4$ |
| | $I_{1-4} \leqq I < I_{1-5}$ | $Q_{45}$ | $Q_{45} = (Q_4 + Q_5)/2$ | $Q_4 \leqq Q_{45} < Q_5$ |
| ⋮ | ⋮ | ⋮ | | ⋮ |
| $F_n$ | $I_{n-0} \leqq I < I_{n-1}$ | $Q_{01}$ | $Q_{01} = (Q_0 + Q_1)/2$ | $Q_0 \leqq Q_{01} < Q_1$ |
| | $I_{n-1} \leqq I < I_{n-2}$ | $Q_{12}$ | $Q_{12} = (Q_1 + Q_2)/2$ | $Q_1 \leqq Q_{12} < Q_2$ |
| | $I_{n-2} \leqq I < I_{n-3}$ | $Q_{23}$ | $Q_{23} = (Q_2 + Q_3)/2$ | $Q_2 \leqq Q_{23} < Q_3$ |
| | $I_{n-3} \leqq I < I_{n-4}$ | $Q_{34}$ | $Q_{34} = (Q_3 + Q_4)/2$ | $Q_3 \leqq Q_{34} < Q_4$ |
| | $I_{n-4} \leqq I < I_{n-5}$ | $Q_{45}$ | $Q_{45} = (Q_4 + Q_5)/2$ | $Q_4 \leqq Q_{45} < Q_5$ |

AIR-CONDITIONING APPARATUS

CROSS REFERENCE TO RELATED APPLICATION

This application is a U.S. national stage application of PCT/JP2018/041477 filed on Nov. 8, 2018, the contents of which are incorporated herein by reference.

TECHNICAL FIELD

The present disclosure relates to an air-conditioning apparatus that supplies air from an indoor unit to an air-conditioned space.

BACKGROUND ART

Conventionally, there is an air-conditioning device where an external static pressure and air flow rate are calculated without using a static pressure detector to control the rotation of an air-sending device of an indoor unit (see Patent Literature 1, for example). In the air-conditioning device disclosed in Patent Literature 1, the rotation of the air-sending device is controlled based on the external static pressure obtained from the rotation speed of the air-sending device and based on an external static pressure at the time of rated air flow rate control stored in advance.

CITATION LIST

Patent Literature

Patent Literature 1: International Publication No. WO 2010/131336

SUMMARY OF INVENTION

Technical Problem

In the air-conditioning device disclosed in Patent Literature 1, when a static pressure fluctuates due to variations in the opening degree of a duct, the rotation speed necessary for the air-sending device is calculated from external static pressure without detecting the variations in air flow. Therefore, there is a possibility that the rotation speed calculated each time that static pressure fluctuates has a large margin of error.

The present disclosure has been made to solve the above-mentioned problem, and an object of the present disclosure is to provide an air-conditioning apparatus that can improve ease of control of the rotation speed of the fan in response to fluctuations in static pressure.

Solution to Problem

An air-conditioning apparatus according to an embodiment of the present disclosure includes: a fan configured to send air to an air-conditioned space; a fan motor configured to drive the fan; a duct having a plurality of air outlets, the air sent by the fan flowing through the duct; a detection unit configured to detect an air flow rate of the fan; a damper provided to each of the plurality of air outlets; and a fan motor control unit configured to control a rotation speed of the fan motor such that the air flow rate assumes a constant value relative to variations in an opening degree of the damper of a plurality of dampers.

Advantageous Effects of Invention

According to the embodiment of the present disclosure, the rotation speed of the fan motor is controlled based on an air flow rate detected by the detection unit such that the air flow rate assumes a constant value relative to fluctuations in static pressure. Therefore, it is possible to improve ease of control of the rotation of the fan according to the variations in air flow.

BRIEF DESCRIPTION OF DRAWINGS

FIG. 5 is a block diagram for describing control performed by a controller shown in FIG. 1.

FIG. 6 is a diagram showing an example of a table stored by a storage unit shown in FIG. 5.

DESCRIPTION OF EMBODIMENTS

Embodiment 1

Figure 1:
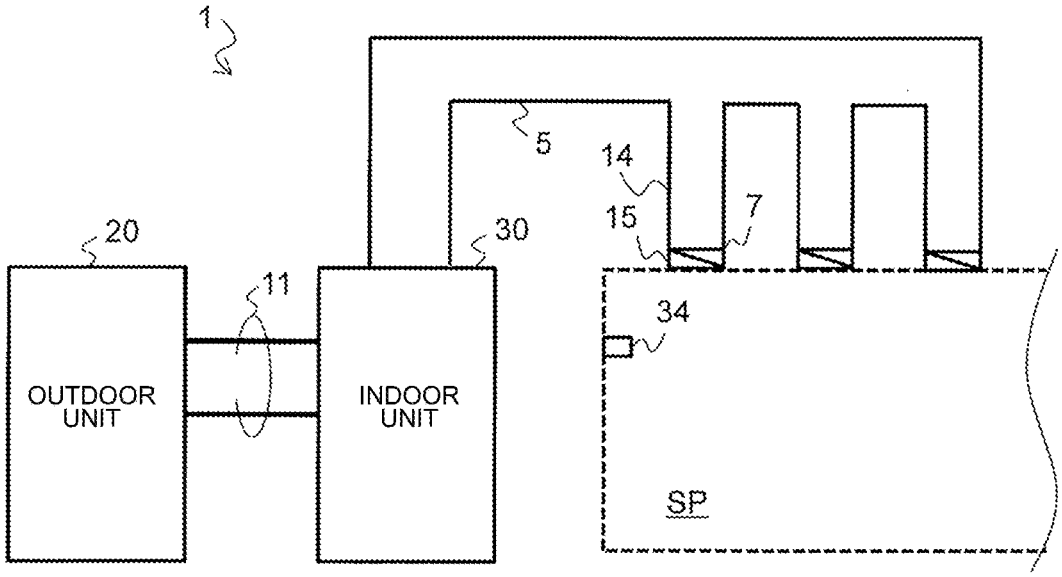
FIG. 1 is a diagram showing a configuration example of an air-conditioning apparatus according to Embodiment 1 of the present disclosure.

The configuration of an air-conditioning apparatus of Embodiment 1 will be described. FIG. 1 is a diagram showing a configuration example of the air-conditioning apparatus according to Embodiment 1 of the present disclosure. As shown in FIG. 1, an air-conditioning apparatus 1 includes an outdoor unit 20, an indoor unit 30, a duct 5 connected to the indoor unit 30, a plurality of branch ducts 14 branched from the duct 5, and dampers 15 provided to air outlets 7 of the respective branch ducts 14. The plurality of dampers 15 are connected to an air-conditioned space SP. A room temperature sensor 34 is provided to the air-conditioned space SP, and the room temperature sensor 34 detects the room temperature of a room forming the air-conditioned space SP.

The configuration example shown in FIG. 1 shows a case where three air outlets 7 are formed on the duct 5. However, the number of air outlets 7 is not limited to three. Further, the plurality of dampers 15 are connected to the same air-conditioned space SP. However, the dampers 15 may be connected to different air-conditioned spaces. For example, the room forming the air-conditioned space SP shown in FIG. 1 may be partitioned into a plurality of rooms corresponding to the dampers 15.

Figure 2:
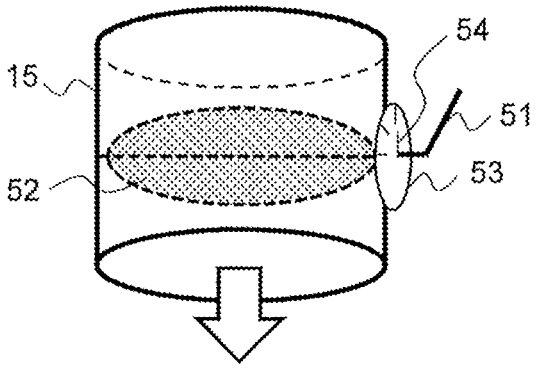
FIG. 2 is a schematic view showing an example of a damper shown in FIG. 1.

FIG. 2 is a schematic view showing an example of the damper shown in FIG. 1. The damper 15 is an air flow rate control valve that can adjust the opening degree thereof. The damper 15 shown in FIG. 2 is a cylindrical volume damper. An arrow shown in FIG. 2 shows the flow direction of air. The damper 15 includes a handle 51 for regulating the opening degree, a rotary blade 52 mounted on the handle 51 and having a circular shape, and a scale plate 53 having a scale showing the opening degree. A pointer 54 is mounted on the handle 51, so when a user turns the handle 51, the position of the tip of the pointer varies corresponding to the rotation angle of the handle 51. The user can finely adjust air flow rate by adjusting the opening degree of the damper 15, not only to a fully open state or a fully closed state, but also to intermediate states between the fully open state and the fully closed state, while observing the scale plate 53. Hereinafter, a case where the damper 15 is in the fully open state is simply referred to as "open state", and a case where the damper 15 is in the fully closed state is simply referred to as "closed state".

Figure 3:
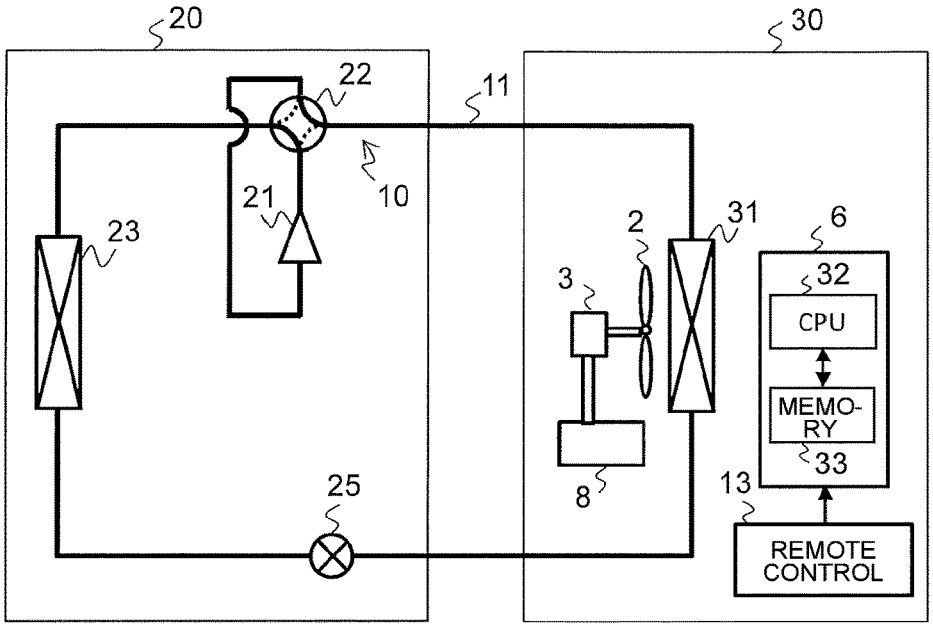
FIG. 3 is a diagram showing an example of a refrigerant circuit of an outdoor unit and an indoor unit shown in FIG. 1.

FIG. 3 is a diagram showing an example of a refrigerant circuit of the outdoor unit and the indoor unit shown in FIG. 1. The outdoor unit 20 includes a compressor 21, a flow passage switching device 22, a heat-source-side heat exchanger 23, and an expansion device 25. The compressor 21 compresses and discharges refrigerant. The flow passage switching device 22 switches flow directions of the refrigerant. The heat-source-side heat exchanger 23 exchanges heat between the refrigerant and outside air. The expansion device 25 expands the refrigerant by decompressing the refrigerant. The indoor unit 30 includes a load-side heat exchanger 31, a fan 2, a controller 6, and a remote control 13. The load-side heat exchanger 31 exchanges heat between the refrigerant and air to be supplied to the air-conditioned space SP. The fan 2 sends air subjected to the heat exchange to the air-conditioned space SP. The remote control 13 is an input device with which a user inputs instructions, such as an operation mode and a set temperature Ts, into the air-conditioning apparatus 1. A fan motor 3 that drives the fan is connected to the fan 2. Further, in the configuration example shown in FIG. 3, an inverter 8 is connected to the fan motor 3. The compressor 21, the load-side heat exchanger 31, the expansion device 25, and the heat-source-side heat exchanger 23 are connected by a refrigerant pipe 11, thus forming a refrigerant circuit 10 through which the refrigerant cycles.

The compressor 21 may be, for example, an inverter compressor that can control a capacity. The flow passage switching device 22 switches flow passages for refrigerant corresponding to the operation mode, such as a heating operation or a cooling operation.

The flow passage switching device 22 may be a four-way valve, for example. The expansion device 25 is a device that controls the flow rate of refrigerant. The expansion device 25 may be an electronic expansion valve, for example. The heat-source-side heat exchanger 23 and the load-side heat exchanger 31 may be fin-and-tube type heat exchangers, for example.

Although not shown in FIG. 3, a fan that supplies outside air to the heat-source-side heat exchanger 23 may be provided to the outdoor unit 20. In the configuration example shown in FIG. 3, the controller 6 is provided to the indoor unit 30. However, the controller 6 may be provided to the outdoor unit 20.

Figure 4:
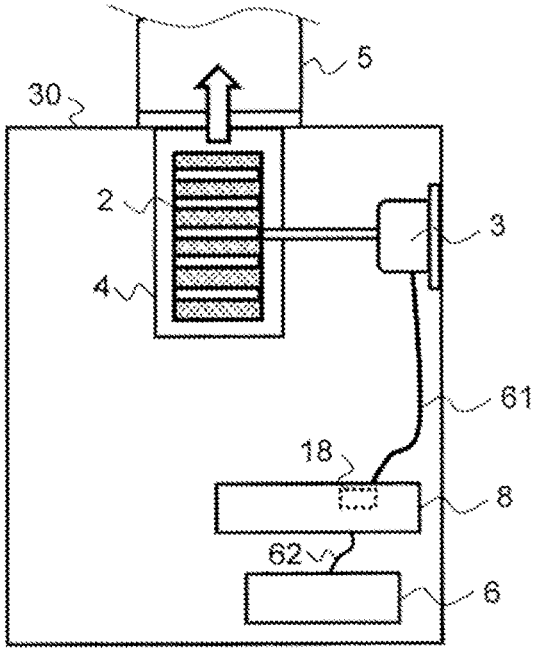
FIG. 4 is a diagram for describing the configuration of the main part of the indoor unit shown in FIG. 3.

FIG. 4 is a diagram for describing the configuration of the main part of the indoor unit shown in FIG. 3. As shown in FIG. 4, the fan 2 is covered by a fan casing 4. An arrow shown in FIG. 4 shows the flow direction of air sent by the fan 2. The shaft of the fan 2 is connected to the fan motor 3. The fan motor 3 is connected with the inverter 8 via a power line 61. The inverter 8 is connected with the controller 6 via a signal line 62. An ammeter 18 is provided to the inverter 8, and the ammeter 18 detects a secondary current I of the inverter 8. The secondary current I of the inverter 8 corresponds to the input current of the fan motor 3. The inverter 8 switches power to be supplied to the fan motor 3 according to a frequency Fj designated by the controller 6.

The flow of refrigerant in the refrigerant circuit 10 shown in FIG. 3 will be described. First, the flow of refrigerant when the air-conditioning apparatus 1 performs the cooling operation will be described. When the air-conditioning apparatus 1 performs the cooling operation, the flow passage switching device 22 switches the flow passages according to the instruction from the controller 6 such that refrigerant discharged from the compressor 21 flows into the heat-source-side heat exchanger 23. The compressor 21 compresses refrigerant at low temperature and low pressure, and discharges gas refrigerant at high temperature and high pressure. The gas refrigerant discharged from the compressor 21 flows into the heat-source-side heat exchanger 23 via the flow passage switching device 22. The refrigerant exchanges heat with outside air in the heat-source-side heat exchanger 23, thus being condensed to form liquid refrigerant at low temperature and high pressure, and the liquid refrigerant flows out from the heat-source-side heat exchanger 23.

The liquid refrigerant is formed into liquid refrigerant at low temperature and low pressure by the expansion device 25. The liquid refrigerant at low temperature and low pressure flows into the load-side heat exchanger 31. The refrigerant exchanges heat with air in the load-side heat exchanger 31, thus evaporating to form gas refrigerant at low temperature and low pressure. The refrigerant receives heat from air in the load-side heat exchanger 31, so that air to be supplied to the air-conditioned space SP by the fan 2 is cooled. The refrigerant subjected to the heat exchange flows out from the load-side heat exchanger 31, and is suctioned by the compressor 21 via the flow passage switching device 22. During a period where the air-conditioning apparatus 1 performs the cooling operation, a cycle is repeated where refrigerant discharged from the compressor 21 flows through the heat-source-side heat exchanger 23, the expansion device 25, and the load-side heat exchanger 31 in this order and, thereafter, is suctioned by the compressor 21.

Subsequently, the flow of refrigerant when the air-conditioning apparatus 1 performs the heating operation will be described. When the air-conditioning apparatus 1 performs the heating operation, the flow passage switching device 22 switches the flow passages according to the instruction from the controller 6 such that the refrigerant discharged from the compressor 21 flows into the load-side heat exchanger 31. Gas refrigerant at high temperature and high pressure discharged from the compressor 21 flows into the load-side heat exchanger 31 via the flow passage switching device 22. The refrigerant exchanges heat with air in the load-side heat exchanger 31, thus being condensed to form liquid refrigerant at intermediate temperature and high pressure. The refrigerant transfers heat to air in the load-side heat exchanger 31, so that air to be supplied to the air-conditioned space SP by the fan 2 is heated.

The liquid refrigerant subjected to the heat exchange flows out from the load-side heat exchanger 31, and flows into the expansion device 25. The liquid refrigerant is formed into liquid refrigerant at low temperature and low pressure by the expansion device 25. The liquid refrigerant at low temperature and low pressure flows into the heat-source-side heat exchanger 23. The refrigerant exchanges heat with outside air in the heat-source-side heat exchanger 23, thus evaporating to form gas refrigerant at low temperature and low pressure, and the gas refrigerant flows out from the heat-source-side heat exchanger 23. The refrigerant flowing out from the heat-source-side heat exchanger 23 is suctioned by the compressor 21 via the flow passage switching device 22. During a period where the air-conditioning apparatus 1 performs the heating operation, a cycle is repeated where refrigerant discharged from the compressor 21 flows through the load-side heat exchanger 31, the expansion device 25, and the heat-source-side heat exchanger 23 in this order and, thereafter, is suctioned by the compressor 21.

Next, the configuration of the controller 6 shown in FIG. 1 will be described, FIG. 5 is a block diagram for describing control performed by the controller shown in FIG. 1. As shown in FIG. 3, the controller 6 includes a memory 33 that stores a program, and a central processing unit (CPU) 32 that executes the program. As shown in FIG. 5, the controller 6 receives inputs of detection values from the ammeter 18 and the room temperature sensor 34. The controller 6 may receive detection values from the ammeter 18 and the room temperature sensor 34 at fixed intervals. The controller 6 receives, from the remote control 13, an instruction signal containing contents inputted by a user by operating the remote control 13.

The controller 6 includes a refrigeration cycle control unit 41, a storage unit 42, a calculation unit 43, and a fan motor control unit 44. The storage unit 42 forms a part of the memory 33. Execution of the program by the CPU 32 forms the refrigeration cycle control unit 41, the calculation unit 43, and the fan motor control unit 44.

The refrigeration cycle control unit 41 controls the flow passage switching device 22 according to a set operation mode. The refrigeration cycle control unit 41 controls the refrigeration cycle of refrigerant cycling through the refrigerant circuit 10 such that the detection value from the room temperature sensor 34 approximates a set temperature Ts. Specifically, the refrigeration cycle control unit 41 controls the operating frequency of the compressor 21 and the opening degree of the expansion device 25. The refrigeration cycle control unit 41 notifies the calculation unit 43 of an air flow rate Q0 set by the user via the remote control 13.

As shown in FIG. 5, the air-conditioning apparatus 1 includes a detection unit 9 that detects an air flow rate Q of the fan 2. The detection unit 9 includes the storage unit 42, the ammeter 18, and the calculation unit 43. The storage unit 42 stores a table showing the relationship among the air flow rate Q of the fan 2, the secondary current I of the inverter 8, and the rotation speed of the fan motor 3. In Embodiment 1, the description will be made for a case where, in place of the rotation speed of the fan motor 3, a frequency F of the inverter 8 is described in the table stored by the storage unit 42. The storage unit 42 also stores static pressure relationship information showing the relationship among the static pressure in the duct 5, the air flow rate Q, and the rotation speed of the fan motor 3. In Embodiment 1, the description will be made for a case where, in place of the rotation speed of the fan motor 3, the frequency F of the inverter 8 is described as the static pressure relationship information stored by the storage unit 42. Hereinafter, the table stored by the storage unit 42 is referred to as "IQF relationship table".

The calculation unit 43 obtains the air flow rate Q of the fan 2 from the secondary current I detected by the ammeter 18 and from the IQF relationship table stored by the storage unit 42. The calculation unit 43 also obtains, from the obtained air flow rate Q and from the static pressure relationship information, the frequency Fj of the inverter 8 that makes the air flow rate Q of the fan 2 constant such that the air flow rate Q assumes the air flow rate Q0 notified by the refrigeration cycle control unit 41. Assume that "j" is a positive integer of 0 or more. The calculation unit 43 notifies the fan motor control unit 44 of the obtained frequency Fj of the inverter 8. The fan motor control unit 44 controls the rotation speed of the fan motor 3 such that the air flow rate of the fan 2 assumes a constant value relative to the variations in the opening degrees of the plurality of dampers 15. In Embodiment 1, the fan motor control unit 44 controls the rotation speed of the fan motor 3 by designating the frequency Fj notified by the calculation unit 43 for the inverter 8.

FIG. 6 is a diagram showing an example of the table stored by the storage unit shown in FIG. 5. As shown in FIG. 6, the IQF relationship table describes the secondary current I of the inverter 8 and the air flow rate Q corresponding to the frequency F. The description will be made with reference to FIG. 6 for making the air flow rate Q constant by varying the frequency Fj when the secondary current I fluctuates. For example, consider a case where when the frequency Fj is $F_1$, the secondary current I rises from a range from $I_{1-1}$ to $I_{1-2}$ to a range from $I_{1-2}$ to $I_{1-3}$, so that the air flow rate Q rises from $Q_{12}$ to $Q_{23}$. In this case, the air flow rate Q can be returned to $Q_{12}$ by reducing the frequency Fj from $F_1$ to $F_0$, and by reducing the secondary current I to a range from $I_{0-1}$ to $I_{0-2}$.

Note that the IQF relationship table shown in FIG. 6 merely forms an example, and the relationship among the air flow rate Q, the secondary current I, and the frequency Fj may be different from the relationship shown in FIG. 6 depending on the length of the flow passage of the duct 5 and the size, the shape or other aspects of the cross section of the flow passage.

Figure 7:
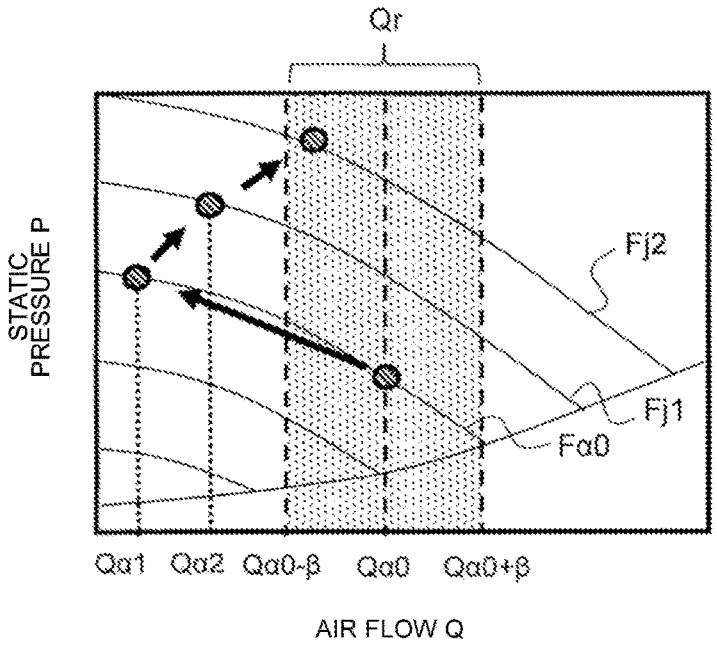
FIG. 7 is a diagram for describing an example of static pressure relationship information stored by the storage unit shown in FIG. 5.

FIG. 7 is a diagram for describing an example of the static pressure relationship information stored by the storage unit shown in FIG. 5. The vertical axis in FIG. 7 shows a static pressure P in the duct 5, and the horizontal axis in FIG. 7 shows air flow rate Q. As shown in FIG. 7, the frequencies F of the inverter 8 are written in the static pressure relationship information. In FIG. 7, the air flow rate Qα0 is used as the reference value. A range of the air flow rate Qα0±β, the air flow rate Qα0 being the reference, is assumed as an air flow rate range Qr, which is considered as a range substantially equal to the air flow rate Qα0.

The description will be made with reference to FIG. 7 for making the air flow rate Q constant by varying the frequency Fj when the air flow rate Q varies. When a static pressure P rises from a state where the air flow rate is Qα0 and the frequency is Fα0, the air flow rate Q drops to Qα1. When the frequency Fj is changed to frequency Fj1, the air flow rate Q recovers to the air flow rate Qα2. When the frequency Fj is further changed to frequency Fj2, the air flow rate Q increases, thus falling within the air flow rate range Qr. In this manner, by referring to the static pressure relationship information, it is possible to determine the frequency F that can return the air flow rate Q to within the air flow rate range Qr even when the air flow rate Q falls outside the air flow rate range Qr.

Figure 8:
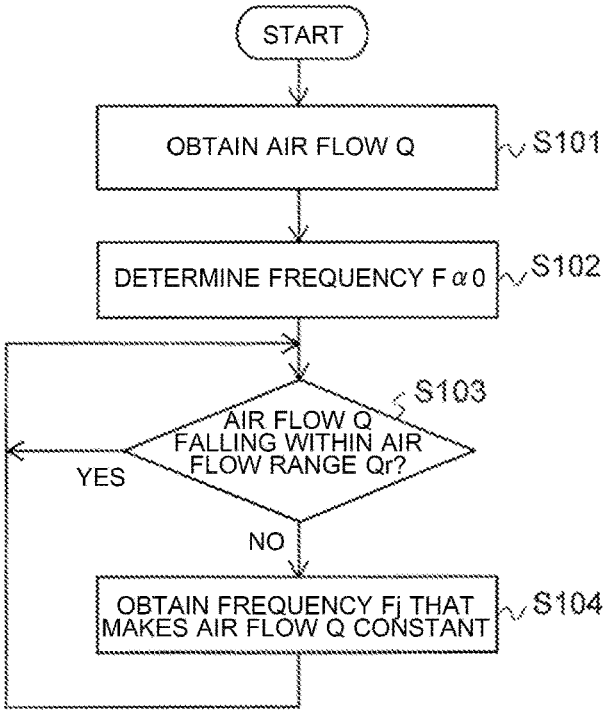
FIG. 8 is a flowchart showing the operation procedure of the air-conditioning apparatus according to Embodiment 1 of the present disclosure.

The manner of operation of the air-conditioning apparatus 1 of Embodiment 1 will be described. FIG. 8 is a flowchart showing the operation procedure of the air-conditioning apparatus according to Embodiment 1 of the present disclosure. The description will be made for a case where a user sets the air flow rate Qα0 by operating the remote control 13 at the time of turning on the air-conditioning apparatus 1. The operation mode of the air-conditioning apparatus 1 may be either one of a heating mode or a cooling mode.

When the air-conditioning apparatus 1 starts the operation, the controller 6 receives the secondary current I from the ammeter 18. The calculation unit 43 obtains the air flow rate Q of the fan 2 from the secondary current I and the IQF relationship table stored by the storage unit 42 (step S101). In obtaining the air flow rate Q, it is desirable for the calculation unit 43 to use a detection value received from the ammeter 18 after the lapse of a certain time period τ0 from the start of the operation of the air-conditioning apparatus 1. The time period τ0 is a stabilization time period required before the rotation of the fan 2 is stabilized. The time period τ0 may be 10 to 30 seconds, for example.

Subsequently, by referring to the IQF relationship table, which is stored by the storage unit 42, the calculation unit 43 determines the frequency Fα0 of the inverter 8 in an initial stage such that the obtained air flow rate Q assumes the set air flow rate Qα0 (step S102). The storage unit 42 stores the frequency Fα0 in the initial stage. The calculation unit 43 notifies the fan motor control unit 44 of the determined frequency Fα0. The fan motor control unit 44 designates the frequency Fα0 for the inverter 8.

Consider the relationship between the air flow rate Q and the open/closed states of three dampers 15 shown in FIG. 1 at the time of turning on the air-conditioning apparatus 1. In Embodiment 1, the open/closed state means information indicating that the damper 15 is in either one of the open state or the closed state. The resistance of air flowing through the duct 5 varies with the open/closed states of the plurality of dampers 15 provided to the outlet side of the duct 5. There is a tendency that the larger the number of dampers 15 in the open state, the smaller the resistance of air, and the larger the number of dampers 15 in the closed state, the larger the resistance of air. The magnitude of the resistance of air in the duct 5 affects the air flow rate Q. Further, the static pressure in the air-conditioned space SP into which air flows through the plurality of dampers 15 also affects the air flow rate Q. Therefore, in the case where the air flow rate Q is set to the air flow rate Qα0 by a user, it is necessary for the calculation unit 43 to obtain the air flow rate Q corresponding to the open/closed states of the plurality of dampers 15 in the initial stage following the start of the operation of the air-conditioning apparatus 1.

Thereafter, the calculation unit 43 obtains the air flow rate Q at fixed intervals, and determines whether the air flow rate Q falls within the air flow rate range Qr that uses the air flow rate Qα0 as the reference (step S103). When the air flow rate Q falls within the air flow rate range Qr, the calculation unit 43 determines that the air flow rate Q is constant, and the processing returns to step S103. In contrast, when the air flow rate Q falls outside the air flow rate range Qr, the calculation unit 43 determines that the air flow rate Q is not constant. As an example of a situation where the air flow rate Q varies in step S103, it is possible that the opening degree of at least one of the plurality of dampers 15 shown in FIG. 1 is varied, thus causing fluctuations in the static pressure in the duct 5. A situation may also be considered where when the number of dampers 15 in the closed state increases, the rotation of the fan motor 3 is restrained, and the secondary current I of the inverter 8 increases.

When the air flow rate Q falls outside the air flow rate range Qr in step S103, the calculation unit 43 determines, by referring to the static pressure relationship information, the frequency Fj of the inverter 8 at which the air flow rate Q falls within the air flow rate range Qr (step S104). Specifically, when the obtained air flow rate Q is less than the air flow rate range Qr, the calculation unit 43 increases the frequency Fj. When the obtained air flow rate Q is greater than the air flow rate range Qr, the calculation unit 43 reduces the frequency Fj. The calculation unit 43 notifies the fan motor control unit 44 of the determined frequency Fj. The fan motor control unit 44 designates the frequency Fj for the inverter 8.

The case has been described, with reference to FIG. 8, where the user sets the air flow rate Qα0 forming the reference value by operating the remote control 13. However, the air flow rate Qα0 forming the reference value is not limited to the air flow rate set by the user at the time of turning on the air-conditioning apparatus 1. The air flow rate Qα0 forming the reference value may be an air flow rate stored in advance by the storage unit 42. Alternatively, it may be configured such that the storage unit 42 stores the air flow rate Q when the air-conditioning apparatus 1 stops the previous operation, and the air flow rate Q stored by the storage unit 42 is used as the reference value of the air flow rate Q when the air-conditioning apparatus 1 is turned on next time. In this case, the storage unit 42 may store not only the air flow rate Qα0 forming the reference value, but also the frequency Fα0 that corresponds to the air flow rate Qα0.

For example, consider the case where the air-conditioned space SP is a workspace in a manufacturing factory, and a plurality of workers work side by side along a manufacturing line. Further, in such a case, assume that the damper 15 is disposed above each worker. In such a manufacturing line, when a worker takes a break in turn, the damper 15 at a location where there is no worker is closed. At this point of operation, the static pressure in the duct 5 fluctuates. A worker remaining in the manufacturing line to work may feel discomfort due to an increase in the air flow rate Q impinging on the worker. When the air-conditioning apparatus 1 performs the cooling operation, the worker feels cold due to an increase in the air flow rate Q.

Further, in the case of the above-mentioned factory, the number of workers may vary depending on products in the course of manufacture flowing through the manufacturing line. Consider a case where the number of workers for manufacturing products A is less than the number of workers for manufacturing products B. In such a case, when products flowing through the manufacturing line are switched from the products A to the products B, the damper 15 at a location where there is no worker in the previous operation is opened. At this point of operation, the static pressure in the duct 5 fluctuates. When the air flow rate Q at which the products A flow through the manufacturing line is maintained, the air flow rate Q reduces, so that a worker involved in a manufacturing work for the products B may feel discomfort. In the case where the air-conditioning apparatus 1 performs the cooling operation, the worker feels hot and humid due to a reduction in the air flow rate Q.

Even when the static pressure in the duct 5 fluctuates due to a worker freely opening/closing the damper 15 located close to the worker in the manufacturing factory, in Embodiment 1, air flow rate is automatically adjusted such that the air flow rate Q assumes a constant value as described with reference to FIG. 8. Therefore, even when the opening degrees of the plurality of dampers 15 vary, each worker can work without feeling discomfort.

The air-conditioning apparatus 1 of Embodiment 1 is configured to include the detection unit 9 and the fan motor control unit 44. The detection unit 9 detects the air flow rate of the fan 2. The fan motor control unit 44 controls the rotation speed of the fan motor 3 such that the air flow rate Q assumes a constant value relative to the variations in the opening degrees of the plurality of dampers 15.

According to Embodiment 1, the rotation speed of the fan motor 3 is controlled based on the air flow rate detected by the detection unit 9 such that an air flow rate assumes a constant value relative to the fluctuations in static pressure. Therefore, it is possible to improve ease of control of the rotation of the fan 2 according to the variations in air flow. The rotation of the fan 2 is automatically controlled such that the air flow rate in the duct 5 assumes a constant value even when the opening degree of any one of the plurality of dampers 15 varies. Therefore, even when the static pressure fluctuates due to the variations in the opening degree of the damper 15, the variations in air flow rate of the air flow from the damper 15 is suppressed and hence, it is possible to suppress the situation where a person in the air-conditioned space SP feels discomfort.

Further, in Embodiment 1, the calculation unit 43 calculates the air flow rate Q of the fan 2 from the detection value of the secondary current I of the inverter 8 detected by the ammeter 18 and from the table stored by the storage unit 42. The secondary current of the inverter 8 is the input current of the fan motor 3, so the actual rotation of the fan motor 3 is reflected on the secondary current of the inverter 8. As a result, a value approximating to the actual air flow rate can be obtained.

Embodiment 2

An air-conditioning apparatus of Embodiment 2 is configured such that the detection unit detects an air flow rate in the duct as the air flow rate of the fan. In Embodiment 2, components substantially equal to the corresponding components described in Embodiment 1 are given the same reference characters, and the detailed description of such components will be omitted.

Figure 9:
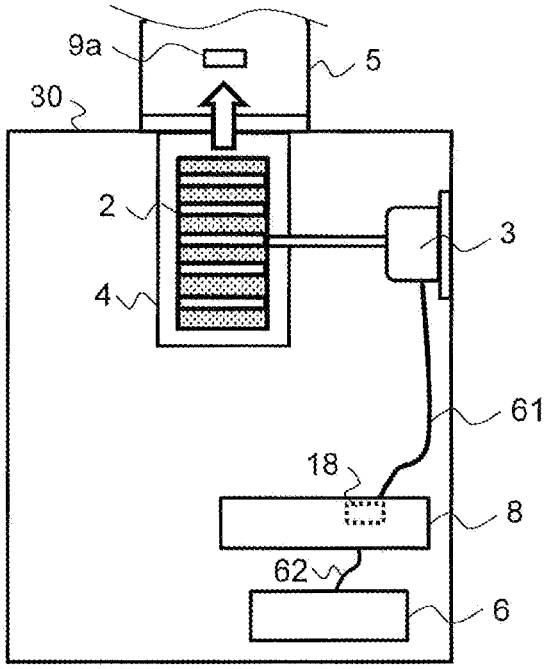
FIG. 9 is a diagram showing a configuration example of the main part of an indoor unit of an air-conditioning apparatus according to Embodiment 2 of the present disclosure.
Figure 10:
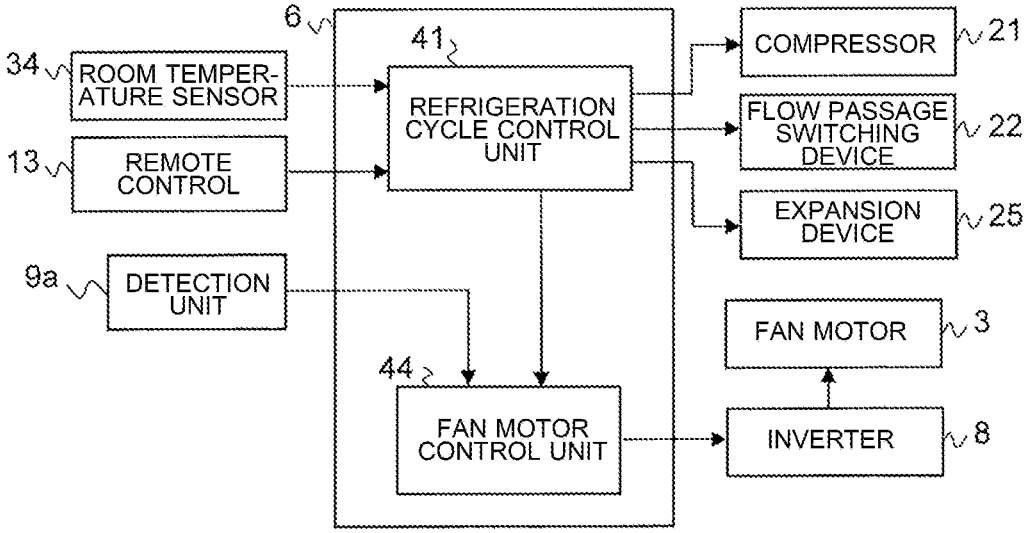
FIG. 10 is a block diagram for describing control performed by a controller of the air-conditioning apparatus according to Embodiment 2 of the present disclosure.

The configuration of the air-conditioning apparatus of Embodiment 2 will be described. FIG. 9 is a diagram showing a configuration example of the main part of the indoor unit of the air-conditioning apparatus according to Embodiment 2 of the present disclosure. FIG. 10 is a block diagram for describing control performed by the controller of the air-conditioning apparatus according to Embodiment 2 of the present disclosure. In Embodiment 2, points that make Embodiment 2 different from Embodiment 1 will be described in detail.

As shown in FIG. 9, the duct 5 connected to the indoor unit 30 is provided with a detection unit 9*a* that detects an air flow rate Q in the duct 5. The detection unit 9*a* may be an air flow sensor, for example. The detection unit 9*a* is communicatively connected with the controller 6 by wired communication or by wireless communication. The detection unit 9*a* detects the air flow rate Q at fixed intervals. The detection unit 9*a* transmits the detection value to the controller 6. The refrigeration cycle control unit 41 notifies the fan motor control unit 44 of the air flow rate Q$\alpha$0 set by the user via the remote control 13. The fan motor control unit 44 controls the rotation speed of the fan motor 3 using the frequency F of the inverter 8 such that the air flow rate Q received from the detection unit 9*a* assumes a constant value at the air flow rate Q$\alpha$0.

Specifically, when the air flow rate Q$\alpha$0 is set at the start of the operation of the air-conditioning apparatus 1, the fan motor control unit 44 controls the frequency Fj of the inverter 8 such that the air flow rate Q received from the detection unit 9*a* falls within a certain air flow rate range Qr that uses the air flow rate Q$\alpha$0 as the reference. When the detection value from the detection unit 9*a* is less than the air flow rate range Qr, the fan motor control unit 44 increases the frequency Fj. In contrast, when the detection value from the detection unit 9*a* is greater than the air flow rate range Qr, the fan motor control unit 44 reduces the frequency Fj.

The manner of operation of the air-conditioning apparatus 1 of Embodiment 2 is substantially equal to the manner of operation in steps S103 to S104 shown in FIG. 8 and hence, the detailed description of the manner of operation of the air-conditioning apparatus 1 of Embodiment 2 will be omitted. Further, in Embodiment 2, the controller 6 may also include the storage unit 42 and the calculation unit 43 described in Embodiment 1.

The air-conditioning apparatus 1 of Embodiment 2 is configured such that the air flow sensor that detects air flow rate is provided to the duct 5. According to Embodiment 2, not only that advantageous effects substantially equal to the advantageous effects in Embodiment 1 can be obtained, but also that air flow rate is directly detected and hence, accuracy in detecting the air flow rate of the fan 2 is improved. As a result, it is also possible to further improve ease of control of making the air flow rate constant.

Embodiment 3

Embodiment 3 is directed to an air-conditioning apparatus configured such that a sensor that detects the opening degree of the damper is provided to the air-conditioning apparatus described in Embodiment 1. In Embodiment 3, components substantially equal to the corresponding components described in Embodiment 1 are given the same reference characters, and the detailed description of such components will be omitted.

Figure 11:
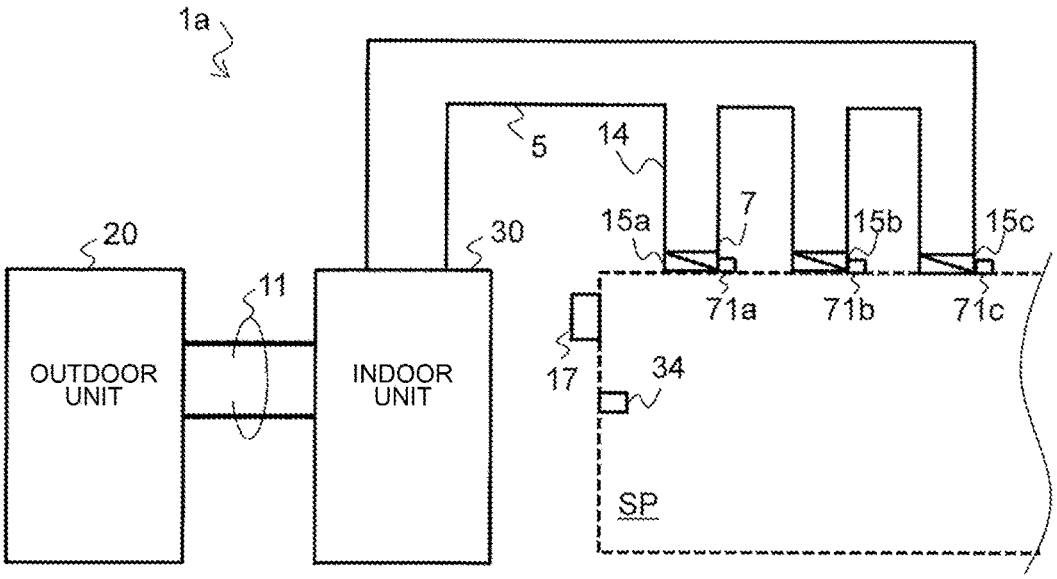
FIG. 11 is a diagram showing a configuration example of the main part of an indoor unit of an air-conditioning apparatus according to Embodiment 3 of the present disclosure.
Figure 12:
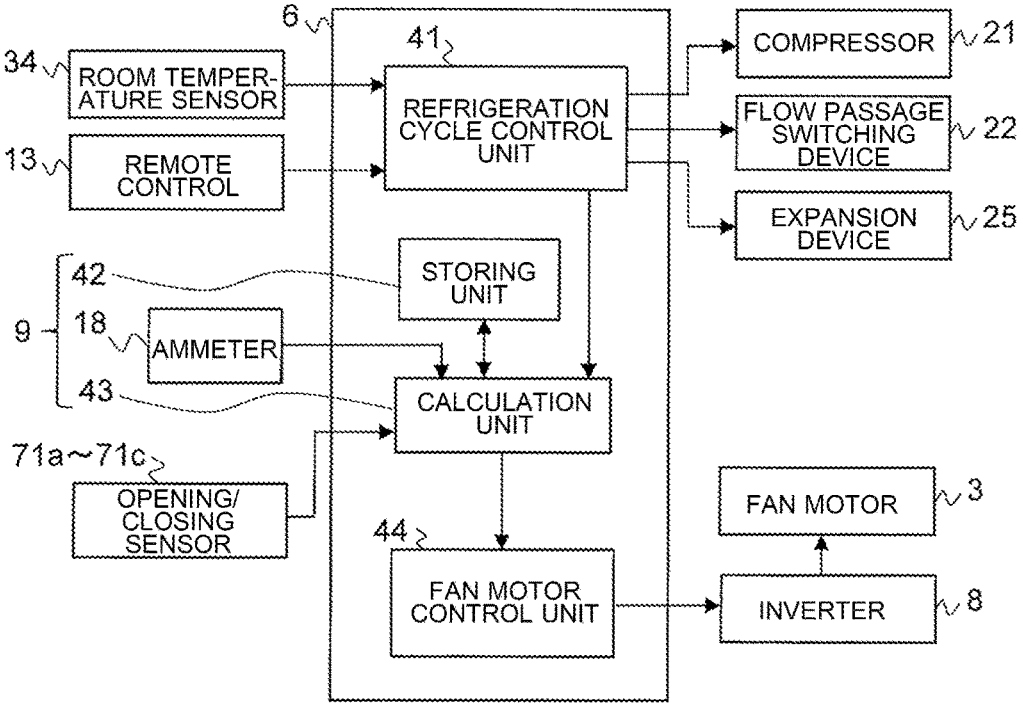
FIG. 12 is a block diagram for describing control performed by a controller of the air-conditioning apparatus according to Embodiment 3 of the present disclosure.

The configuration of the air-conditioning apparatus of Embodiment 3 will be described. FIG. 11 is a diagram showing a configuration example of the main part of the indoor unit of the air-conditioning apparatus according to Embodiment 3 of the present disclosure. FIG. 12 is a block diagram for describing control performed by the controller of the air-conditioning apparatus according to Embodiment 3 of the present disclosure. In Embodiment 3, points that make Embodiment 3 different from Embodiment 1 will be described in detail.

An air-conditioning apparatus 1*a* shown in FIG. 11 includes, in addition to the components described in Embodiment 1, opening/closing sensors 71*a* to 71*c* provided to dampers 15*a* to 15*c* of the plurality of branch ducts 14, and a communication unit 17 communicatively connected with the opening/closing sensors 71*a* to 71*c*. The opening/closing sensors 71*a* to 71*c* and the communication unit 17 may be communicatively connected with each other by wired communication or by wireless communication. In the case of wireless communication, communication between the opening/closing sensors 71*a* to 71*c* and the communication unit 17 may be short range wireless communication, such as Bluetooth (registered trademark), for example. The communication unit 17 is communicatively connected with the controller 6. The communication unit 17 and the controller 6 may also be communicatively connected with each other by wired communication or by wireless communication. The communication unit 17 receives detection values from the opening/closing sensors 71*a* to 71*c* at fixed intervals, and transmits the received detection values to the controller 6.

The opening/closing sensor 71*a* detects the opening degree of the damper 15*a*, and transmits the detection value to the communication unit 17. The opening/closing sensor 71*b* detects the opening degree of the damper 15*b*, and transmits the detection value to the communication unit 17. The opening/closing sensor 71*c* detects the opening degree of the damper 15*c*, and transmits the detection value to the communication unit 17. Hereinafter, the description will be made for a case where the opening/closing sensor 71*a* outputs, as the opening degree of the damper 15*a*, a signal indicating that the damper 15*a* is in either one of the open state or the closed state. The same also applies for the opening/closing sensors 71*b* and 71*c* in the same manner as the opening/closing sensor 71*a*.

The storage unit 42 stores, in addition to the IQF relationship table, opening degree relationship information showing the relationship among open/closed states of the dampers 15*a* to 15*c*, the air flow rate of the duct 5, and the rotation speed of the fan motor 3. Based on the open/closed states of the dampers 15*a* to 15*c* detected by the opening/closing sensors 71*a* to 71*c* and the opening degree relationship information stored by the storage unit 42, the calculation unit 43 obtains the rotation speed of the fan motor 3 that makes the air flow rate Q constant. Also in Embodiment 3, the description will be made for a case where, in place of the rotation speed of the fan motor 3, the frequency F of the inverter 8 is described as the opening degree relationship information stored by the storage unit 42, and the calculation unit 43 determines the frequency F that makes the air flow rate Q constant.

Figure 13:
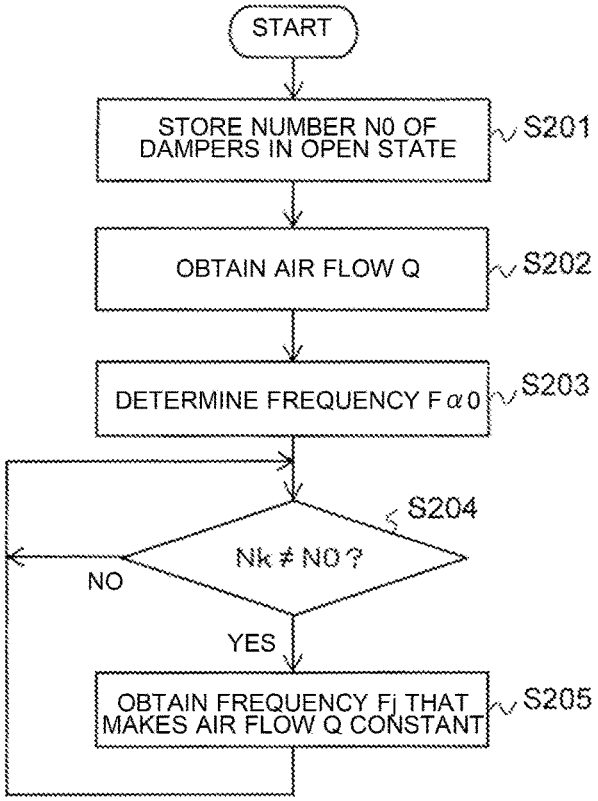
FIG. 13 is a flowchart showing the operation procedure of the air-conditioning apparatus according to Embodiment 3 of the present disclosure.

Next, the manner of operation of the air-conditioning apparatus 1 of Embodiment 3 will be described. FIG. 13 is a flowchart showing the operation procedure of the air-conditioning apparatus according to Embodiment 3 of the present disclosure. The operation mode of the air-conditioning apparatus 1 may be either one of the heating mode or the cooling mode. The description will be made for a case where a user sets the air flow rate Q$\alpha$0 by operating the remote control 13 at the time of turning on the air-conditioning apparatus 1.

When the air-conditioning apparatus 1 starts the operation, the communication unit 17 transmits the detection values from the opening/closing sensors 71*a* to 71*c* to the controller 6. The calculation unit 43 calculates the number N0 of dampers in the open state from the detection values from the opening/closing sensors 71*a* to 71*c*. Then, the calculation unit 43 causes the storage unit 42 to store the number N0 of dampers in the open state as the reference value in the initial stage (step S201). Further, the calculation unit 43 obtains, in the same manner as Embodiment 1, the air flow rate Q of the fan 2 from the IQF relationship table stored by the storage unit 42 and from the detection value received from the ammeter 18 after the lapse of a certain time period $\tau$0 from the start of the operation of the air-conditioning apparatus 1 (step S202).

Subsequently, by referring to the IQF relationship table stored by the storage unit 42, the calculation unit 43 determines the frequency F$\alpha$0 of the inverter 8 in the initial stage such that the air flow rate Q assumes the air flow rate Q$\alpha$0 (step S203). The calculation unit 43 notifies the fan motor control unit 44 of the determined frequency F$\alpha$0. The fan motor control unit 44 designates the frequency F$\alpha$0 for the inverter 8.

Thereafter, the calculation unit 43 receives detection values from the opening/closing sensors 71*a* to 71*c* via the communication unit 17 at fixed intervals, and determines whether the number Nk of dampers in the open state varies from a reference value N0 (step S204). Specifically, the calculation unit 43 calculates the current number Nk of dampers in the open state from the detection value received from the opening/closing sensors 71*a* to 71*c* and the reference value N0 of the damper in the open state in the initial state. When the number Nk of dampers in the open state matches the reference value N0, the calculation unit 43 determines that the air flow rate Q is constant, and the processing returns to step S204. In contrast, when the number Nk of dampers in the open state does not match the reference value N0, the calculation unit 43 determines that the air flow rate Q is not constant.

As an example of a situation where the air flow rate Q varies in step S204, it is possible that the open/closed state of any one of the dampers 15*a* to 15*c* shown in FIG. 11 is varied from the initial stage. When the number of dampers in the open state increases by one, the calculation unit 43 adds 1 to the reference value N0. In contrast, when the number of dampers in the closed state increases by one, the calculation unit 43 subtracts 1 from the reference value N0. The number Nk of dampers in the open state at the time of control is calculated by a formula Nk=N0+(the increased number of dampers in open state)−(the increased number of dampers in closed state).

In step S204, when the number Nk of dampers in the open state does not match the reference value N0, the calculation unit 43 determines, by referring to the opening degree relationship information, the frequency Fj of the inverter 8 that realizes the air flow rate Q$\alpha$0 with the current number Nk of dampers in the open state (step S205). Specifically, when the number Nk of dampers in the open state is greater than the reference value N0, the calculation unit 43 increases the frequency Fj. When the number Nk of dampers in the open state is less than the reference value N0, the calculation unit 43 reduces the frequency Fj. The calculation unit 43 notifies the fan motor control unit 44 of the determined frequency Fj. The fan motor control unit 44 designates the frequency Fj for the inverter 8.

For example, in a manufacturing factory where the air-conditioned space SP shown in FIG. 11 is used as a workspace, there may be a case where a plurality of workers who work along a manufacturing line freely open/close dampers located close to the workers, thus causing fluctuations in the static pressure in the duct 5. Even in such a case, in the air-conditioning apparatus 1*a* of Embodiment 3, the air flow rate is automatically adjusted such that the air flow rate Q assumes a constant value. Therefore, each worker can work without feeling discomfort.

In Embodiment 3, the case has been described where the communication unit 17 is provided. However, the opening/closing sensors 71*a* to 71*c* and the controller 6 may be communicatively connected with each other directly. Further, the case has been described where each of the detection values from the opening/closing sensors 71*a* to 71*c* is a signal indicating either one of the open state or the closed state. However, each of the detection values may also be a signal indicating the opening degree of the dampers 15*a* to 15*c*. Further, Embodiment 3 has been described by using the air-conditioning apparatus of Embodiment 1 as the base. However, Embodiment 3 may also be applied to the air-conditioning apparatus of Embodiment 2.

The air-conditioning apparatus 1*a* of Embodiment 3 includes the opening/closing sensors 71*a* to 71*c* and the calculation unit 43. The opening/closing sensors 71*a* to 71*c* are provided to the plurality of dampers 15*a* to 15*c*. The calculation unit 43 determines the rotation speed of the fan motor 3 that makes an air flow rate constant based on the detected opening degrees of the dampers and the opening degree relationship information.

According to Embodiment 3, the current total opening degree of the dampers 15*a* to 15*c* can be obtained from the detection values from the opening/closing sensors 71*a* to 71*c*. As a result, it is possible to obtain, from the obtained total opening degree and the opening degree relationship information, the rotation speed of the fan 2 that makes an air flow rate constant with higher accuracy.

Embodiment 4

Embodiment 4 is directed to an air-conditioning apparatus configured such that an air flow rate is made constant corresponding to the number of dampers in the open state set by a user in the air-conditioning apparatus described in Embodiment 3. In Embodiment 4, components substantially equal to the corresponding components described in Embodiments 1 and 3 are given the same reference characters, and the detailed description of such components will be omitted.

The configuration of the air-conditioning apparatus of Embodiment 4 will be described with reference to FIG. 11 and FIG. 12. The storage unit 42 stores, in addition to the IQF relationship table, the static pressure relationship information showing the relationship among the static pressure in the duct 5, the air flow rate of the duct 5, and the rotation speed of the fan motor 3. Also in Embodiment 4, the description will be made for a case where, in place of the rotation speed of the fan motor 3, the frequency F of the inverter 8 is described as the static pressure relationship information stored by the storage unit 42, and the calculation unit 43 determines the frequency F that makes the air flow rate Q constant.

When the user inputs the number Nset of dampers set in the open state, and the air flow rate Qα0 as a set air flow rate by operating the remote control 13, the refrigeration cycle control unit 41 notifies the calculation unit 43 of the number Nset of dampers and the air flow rate Qα0. It should be noted that Nset may be the total number of all dampers 15*a* to 15*c*. In the case of the configuration example shown in FIG. 11, the total number of dampers 15*a* to 15*c* is three.

The calculation unit 43 obtains, by referring to the IQF relationship table and the static pressure relationship information, the frequency Fα0 at which the air flow rate Q of the duct 5 assumes the air flow rate Qα0 when Nset number of dampers are in the open state. When the air flow rate Q of the duct 5 is the air flow rate Qα0, the calculation unit 43 calculates the air flow rate Qαc per damper according to the following formula (1).

$$Q\alpha c = Q\alpha 0 / N\text{set} \quad (1)$$

Further, assuming that the current number of dampers in the open state is Nk, the calculation unit 43 calculates the air flow rate Qαk corresponding to the number Nk of dampers in the open state according to the following formula (2) by using the air flow rate Qαc calculated by the formula (1).

$$Q\alpha k = Q\alpha c \times Nk = Q\alpha 0 \times Nk / N\text{set} \quad (2)$$

The calculation unit 43 causes the storage unit 42 to store the air flow rate Qαk calculated by the formula (2) as the reference air flow rate. The calculation unit 43 obtains the frequency Fα0 that realizes the air flow rate Qαk based on the air flow rate Qαk and the static pressure relationship information, and notifies the fan motor control unit 44 of the frequency Fα0. When it is determined from the detection values received from the opening/closing sensors 71*a* to 71*c* that there is a change in the number Nk of dampers in the open state, the calculation unit 43 newly calculates the air flow rate Qαk according to the formula (2). Assuming that the newly calculated air flow rate Qαk is Qαn, the calculation unit 43 updates the air flow rate Qαn to the reference air flow rate stored by the storage unit 42. The calculation unit 43 assumes a certain range from the air flow rate Qαn as the air flow rate range Qr, which is considered as a range substantially equal to the air flow rate Qαn, and the calculation unit 43 causes the storage unit 42 to store the air flow rate range Qr containing the air flow rate Qαn. The calculation unit 43 obtains frequency Fn0 that realizes the air flow rate Qαn based on the air flow rate Qαn and the static pressure relationship information, and notifies the fan motor control unit 44 of the frequency Fn0.

Figure 14:
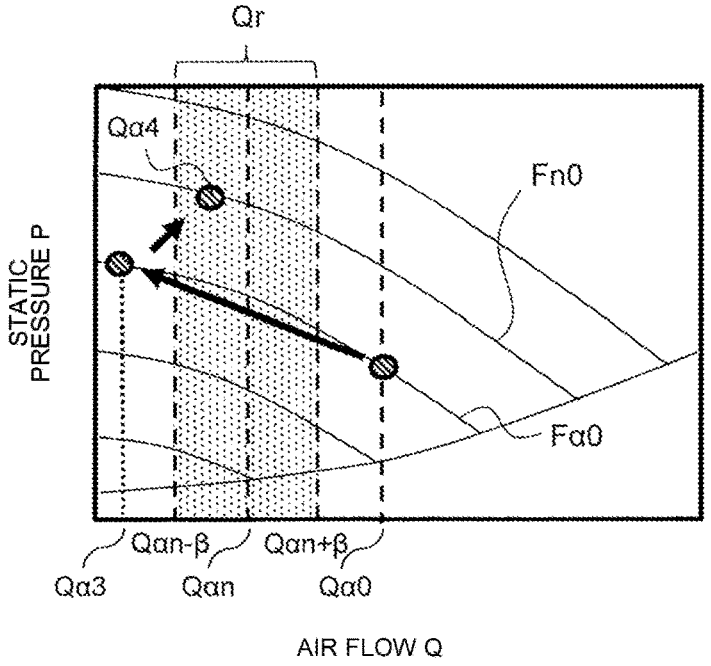
FIG. 14 is a diagram for describing an example of static pressure relationship information stored by a storage unit shown in FIG. 12 in an air-conditioning apparatus according to Embodiment 4 of the present disclosure.

FIG. 14 is a diagram for describing an example of the static pressure relationship information stored by the storage unit shown in FIG. 12 in the air-conditioning apparatus according to Embodiment 4 of the present disclosure. The vertical axis in FIG. 14 shows the static pressure P in the duct 5, and the horizontal axis in FIG. 14 shows air flow rate Q. As shown in FIG. 14, the frequency F of the inverter 8 is written in the static pressure relationship information.

The description will be made with reference to FIG. 14 for making the air flow rate Q constant by varying the frequency Fj when the air flow rate Q varies. When the static pressure P rises from a state where the frequency Fα0 is set with the reference air flow rate Qα0, the air flow rate Q drops to Qα3. The reference air flow rate is updated from the air flow rate Qα0 to the air flow rate Qαn. When the frequency Fj is changed to the frequency Fn0, the air flow rate Q recovers to the air flow rate Qα4. In FIG. 14, range of the air flow rate Qαn±β is the air flow rate range Qr that uses the air flow rate Qαn as the reference. The air flow rate Qα4 falls within the air flow rate range Qr. By referring to the static pressure relationship information as described above, it is possible to determine the frequency F that can return the air flow rate Q to within the air flow rate range Qr even when the reference air flow rate is updated due to the fluctuations in static pressure.

The manner of operation of the air-conditioning apparatus of Embodiment 4 is substantially equal to that in the procedure described with reference to FIG. 8 except for the processing in step S201 and the processing in S205 shown in FIG. 13 and hence, the detailed description of the manner of operation of the air-conditioning apparatus of Embodiment 4 will be omitted. Specifically, in Embodiment 4, when the number Nset of dampers is stored as the number N0 of dampers in step S201 shown in FIG. 13, and when the number Nk of dampers in the open state varies in step S204, the calculation unit 43 updates the reference air flow rate using the formula (2) in step S205.

FIG. 14 shows the static pressure relationship information where the difference between the reference air flow rate Qα0 in the initial stage and the updated reference air flow rate Qαn is greater than a range β. However, the reference air flow rate Qαn may belong to the air flow rate range Qr of the reference air flow rate Qα0. In this case, air flow rate in the duct 5 is also maintained constant. Further, in Embodiment 4, the case has been described where each of the detection values from the opening/closing sensors 71*a* to 71*c* is a signal indicating either one of the open state or the closed state. However, each of the detection values may also be a signal indicating the opening degree of the dampers 15*a* to 15*c*. Further, Embodiment 4 has been described by using the air-conditioning apparatus of Embodiment 3 as the base. However, the detection unit 9 may be the detection unit 9*a* described in Embodiment 2.

The air-conditioning apparatus 1*a* of Embodiment 4 is configured such that when the opening degrees of the dampers 15*a* to 15*c* detected by the opening/closing sensors 71*a* to 71*c* vary, the calculation unit 43 changes the reference air flow rate based on the static pressure relationship information, and obtains the rotation speed of the fan motor 3 that makes an air flow rate constant.

According to Embodiment 4, based on the reference air flow rate set by the user, the rotation speed of the fan 2 is controlled such that the air flow rate of each damper assumes a constant value. When the number of dampers in the open state varies, the reference air flow rate in the duct 5 is updated corresponding to the number of dampers in the open state. Therefore, the air flow rate of each damper in the open state is controlled to assume a constant value before and after the number of dampers in the open state varies. Even when the opening degree of any one of the dampers 15*a* to 15*c* varies, variations in air flow rate of each damper are suppressed and hence, a person who is near the damper does not feel discomfort.

Embodiment 5

Embodiment 5 is directed to an air-conditioning apparatus configured such that a motion sensor is provided to the air-conditioning apparatus described in Embodiment 3, the motion sensor detecting whether there is a person within a certain range from the position of the damper 15. In Embodiment 5, components substantially equal to the corresponding components described in Embodiments 1 and 3 are given the same reference characters, and the detailed description of such components will be omitted.

Figure 15:
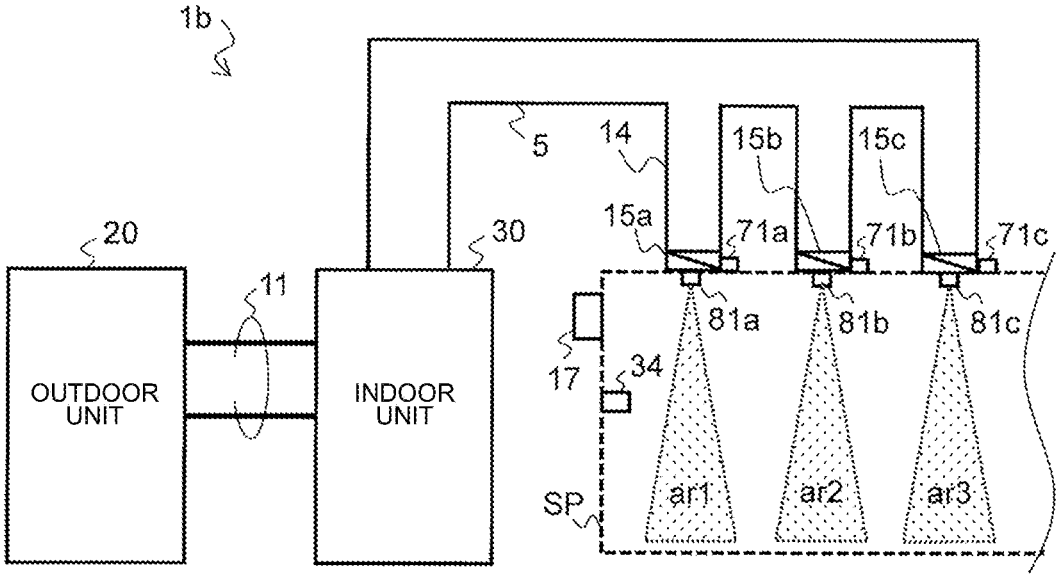
FIG. 15 is a diagram showing a configuration example of the main part of an indoor unit of an air-conditioning apparatus according to Embodiment 5 of the present disclosure.

The configuration of the air-conditioning apparatus of Embodiment 5 will be described. FIG. 15 is a diagram showing a configuration example of the main part of the indoor unit of the air-conditioning apparatus according to Embodiment 5 of the present disclosure. In Embodiment 5, points that make Embodiment 5 different from Embodiment 3 will be mainly described.

An air-conditioning apparatus 1*b* shown in FIG. 15 includes, in addition to the components described in Embodiments 1 and 3, a plurality of motion sensors 81*a* to 81*c* that detect whether a person is present in a certain range from the position of each of the dampers 15*a* to 15*c*. The motion sensors 81*a* to 81*c* are communicatively connected with the communication unit 17. The motion sensors 81*a* to 81*c* and the communication unit 17 may be communicatively connected with each other by wired communication or by wireless communication. The communication unit 17 receives the detection values from the motion sensors 81*a* to 81*c* at fixed intervals, and transmits the received detection values to the controller 6. In FIG. 15, a range ar1 is a range within which the motion sensor 81*a* detects the presence or absence of a person. A range ar2 is a range within which the motion sensor 81*b* detects the presence or absence of a person. A range ar3 is a range within which the motion sensor 81*c* detects the presence or absence of a person.

Figure 16:
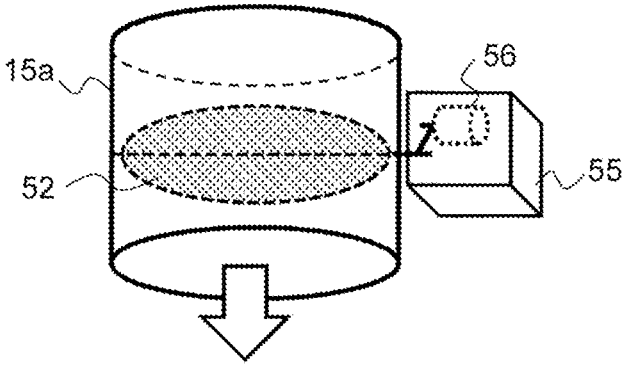
FIG. 16 is a schematic view showing an example of a damper shown in FIG. 15.

FIG. 16 is a schematic view showing an example of the damper shown in FIG. 15. In Embodiment 5, the dampers 15*a* to 15*c* have the same configuration and hence, the configuration of the damper 15*a* will be described. An arrow shown in FIG. 16 shows the flow direction of air. The damper 15*a* includes the rotary blade 52 and a damper drive unit 55. The rotary blade 52 rotates about the shaft to adjust the opening degree. The damper drive unit 55 drives the rotary blade 52. The damper drive unit 55 is communicatively connected with the controller 6 via the communication unit 17. The damper drive unit 55 and the communication unit 17 may be communicatively connected with each other by wired communication or by wireless communication.

The damper drive unit 55 includes a stepping motor 56. The rotary shaft of the stepping motor 56 and the shaft of the rotary blade 52 are connected with each other via a belt. The rotary blade 52 rotates with the rotation of the stepping motor 56. The stepping motor 56 rotates according to the rotation angle instructed by the controller 6. For example, in the case where the rotation angle is 0 degrees, the stepping motor 56 does not drive the rotary blade 52 to maintain the damper 15*a* in the closed state. In the case where the rotation angle is 90 degrees, the stepping motor 56 drives the rotary blade 52 to bring the damper 15*a* into the open state.

Figure 17:
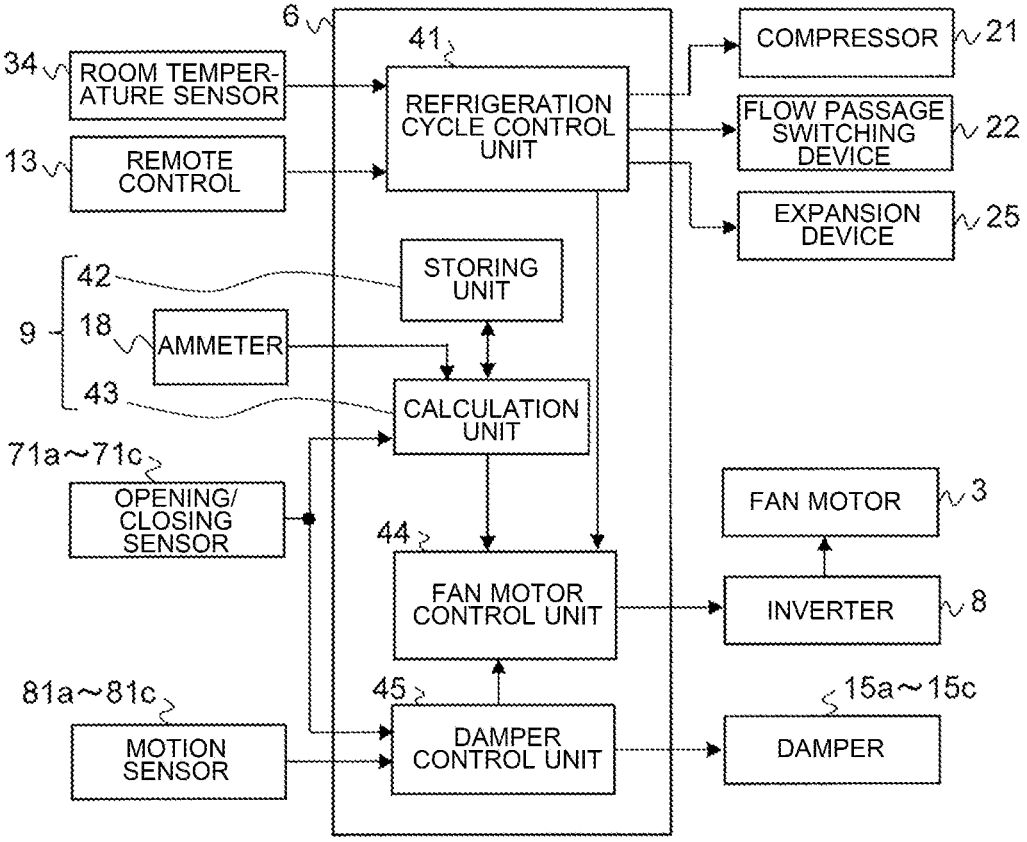
FIG. 17 is a block diagram for describing control performed by a controller of the air-conditioning apparatus according to Embodiment 5 of the present disclosure.

FIG. 17 is a block diagram for describing control performed by the controller of the air-conditioning apparatus according to Embodiment 5 of the present disclosure. As shown in FIG. 17, the controller 6 of Embodiment 5 includes a damper control unit 45 that controls the damper drive units 55 provided to the dampers 15*a* to 15*c*. The damper control unit 45 receives detection values from the motion sensors 81*a* to 81*c* via the communication unit 17, and brings the opening degree of a damper for which the motion sensor detects that there is no person to the closed state by controlling the damper drive unit 55. For example, the damper control unit 45 transmits a control signal that designates a rotation angle of 0 degrees (rotation angle=0 degrees) to the damper drive unit 55 of a damper for which the motion sensor detects that there is no person.

Figure 18:
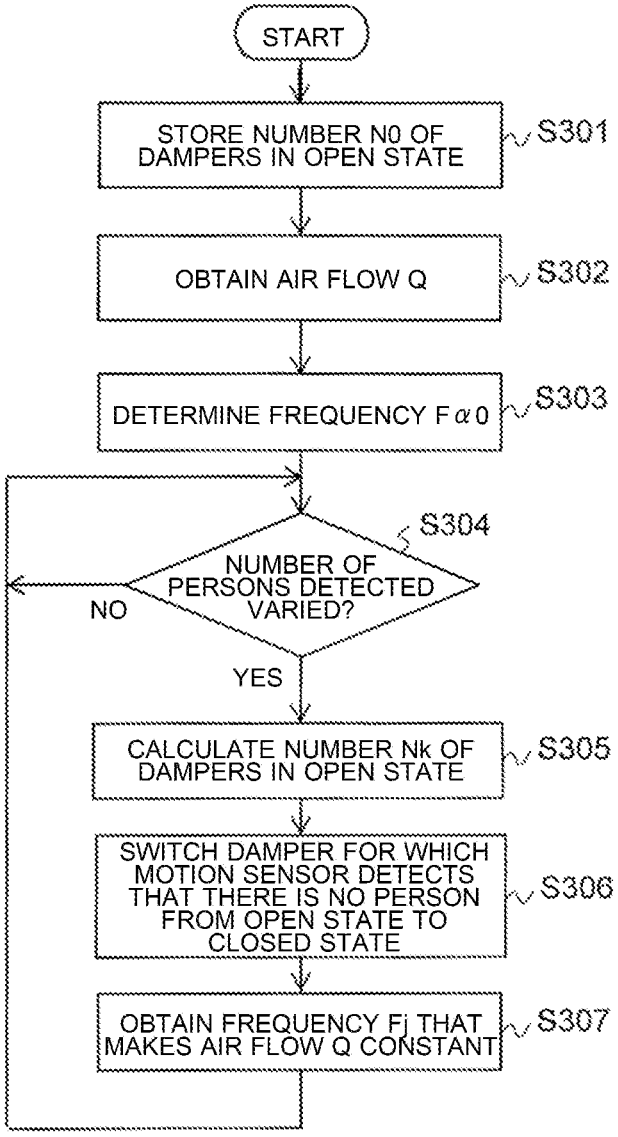
FIG. 18 is a flowchart showing the operation procedure of the air-conditioning apparatus according to Embodiment 5 of the present disclosure.

Next, the manner of operation of the air-conditioning apparatus 1*b* of Embodiment 5 will be described. FIG. 18 is a flowchart showing the operation procedure of the air-conditioning apparatus according to Embodiment 5 of the present disclosure. The operation mode of the air-conditioning apparatus 1*b* may be either one of the heating mode or the cooling mode. The description will be made for a case where a user sets the air flow rate Qα0 by operating the remote control 13 at the time of turning on the air-conditioning apparatus 1*b*. Processing in steps S301 to S303 shown in FIG. 18 are substantially equal to the processing in steps S201 to S203 described with reference to FIG. 13 and hence, the detailed description of the processing in steps S301 to S303 will be omitted in Embodiment 5.

In step S303, when the calculation unit 43 determines the frequency Fα0 of the inverter 8 in the initial stage, the calculation unit 43 notifies the fan motor control unit 44 of the determined frequency Fα0. The fan motor control unit 44 designates the frequency Fα0 for the inverter 8.

Thereafter, the damper control unit 45 receives detection values from the motion sensors 81*a* to 81*c* via the communication unit 17 at fixed intervals, and determines whether there is a change in the number of persons detected (step S304). When there is no change in the number of persons detected, the damper control unit 45 returns the processing in step S304. In contrast, when there is a change in the number of persons detected, the damper control unit 45 switches a damper for which the motion sensor detects that there is no person from the open state to the closed state by controlling the damper drive unit 55 provided to the damper (step S305).

Thereafter, when it is determined from the detection values received from the opening/closing sensors 71*a* to 71*c* at fixed intervals that there is a change in the number Nk of dampers in the open state, the calculation unit 43 calculates the number Nk of dampers in the open state (step S306). Subsequently, the calculation unit 43 determines the frequency Fj of the inverter 8 that realizes the air flow rate Qα0 with the current number Nk of dampers in the open state by referring to the opening degree relationship information (step S307). The calculation unit 43 notifies the fan motor control unit 44 of the determined frequency Fj. The fan motor control unit 44 designates the frequency Fj for the inverter 8.

For example, in the case where a plurality of workers work along the manufacturing line in a manufacturing factory where the air-conditioned space SP shown in FIG. 15 is used as a workspace, a worker may leave the manufacturing line to take a break. In this case, in the air-conditioning apparatus 1*b* of Embodiment 5, the damper is automatically closed even when the worker does not close the damper located close to the worker. The damper is automatically closed and hence, the static pressure in the duct 5 fluctuates. However, the air flow rate is automatically adjusted such that the air flow rate Q assumes a constant value. Therefore, a person working can work without feeling discomfort.

The case has been described, with reference to FIG. 18, where the number of persons detected decreases. However, when the number of persons detected by the motion sensors increases, the damper control unit 45 may control a damper for which the motion sensor detects that there is a person to the open state. In Embodiment 5, the case has been described where the communication unit 17 is provided. However, the plurality of damper drive units 55/the motion sensors 81*a* to 81*c* and the controller 6 may be communicatively connected with each other directly. Further, Embodiment 5 has been described by using the air-conditioning apparatus of Embodiment 3 as the base. However, Embodiment 5 may also be applied to the air-conditioning apparatus of Embodiment 4, and the detection unit 9 may be the detection unit 9*a* described in Embodiment 2.

The air-conditioning apparatus 1*b* of Embodiment 5 includes the plurality of motion sensors 81*a* to 81*c* and the damper control unit 45. The plurality of motion sensors 81*a* to 81*c* detect whether there is a person within a certain range from the position of each damper. The damper control unit 45 controls the open/closed state of the damper corresponding to the detection result from the motion sensor.

According to Embodiment 5, when a person leaves an area near the damper, the damper is automatically switched to the closed state, so that the air flow rate can assume a constant value even when the number of dampers in the open state varies.

REFERENCE SIGNS LIST

1, 1*a*, 1*b* air-conditioning apparatus, 2 fan, 3 fan motor, 4 fan casing, 5 duct, 6 controller, 7 air outlet, 8 inverter, 9, 9*a* detection unit, 10 refrigerant circuit, 11 refrigerant pipe, 13 remote control, 14 branch duct, 15, 15*a* to 15*c* damper, 17 communication unit, 18 ammeter, 20 outdoor unit, 21 compressor, 22 flow passage switching device, 23 heat-source-side heat exchanger, 25 expansion device, 30 indoor unit, 31 load-side heat exchanger, 32 CPU, 33 memory, 34 room temperature sensor, 41 refrigeration cycle control unit, 42 storage unit, 43 calculation unit, 44 fan motor control unit, 45 damper control unit, 51 handle, 52 rotary blade, 53 scale plate, 54 pointer, 55 damper drive unit, 56 stepping motor, 61 power line, 62 signal line, 71*a* to 71*c* opening/closing sensor, 81*a* to 81*c* motion sensor, SP air-conditioned space, ar1 to ar3 range.

The invention claimed is:

1. An air-conditioning apparatus comprising:

a fan configured to send air to an air-conditioned space;

a fan motor configured to drive the fan;

a duct having a plurality of air outlets, the air sent by the fan flowing through the duct;

a detection unit configured to detect an air flow rate of the fan;

a damper provided to each of the plurality of air outlets;

an opening/closing sensor provided to each of the plurality of dampers, and configured to detect an opening degree of the damper;

a processor configured to execute processes in accordance with a program; and a memory configured to store the program, the memory being configured to store static pressure relationship information showing a relationship among static pressure of the fan, the air flow rate, and a rotation speed of the fan motor, and a reference air flow rate corresponding to the opening degree to be set for each of the dampers;

the processor being configured to obtain a rotation speed of the fan motor that makes the air flow rate constant by changing the reference air flow rate based on the static pressure relationship information stored by the memory upon a variation in an opening degree of the plurality of dampers detected by the plurality of the opening/closing sensors, and control a rotation speed of the fan motor such that the rotation speed of the fan motor corresponds to the rotation speed of the fan motor obtained by the processor relative to a variation in the opening degree of the damper of the plurality of dampers;

the detection unit including an ammeter configured to detect an input current of the fan motor;

the memory being further configured to store a table and the static pressure relationship information, the table showing a relationship among the air flow rate, the input current, and a rotation speed of the fan motor; and the processor being configured to determine a rotation speed of the fan motor that makes the air flow rate constant based on the input current detected by the ammeter, and the table and the static pressure relationship information stored by the memory.

2. The air-conditioning apparatus of claim 1, wherein the detection unit is an air flow sensor provided to the duct to detect the air flow rate.

3. The air-conditioning apparatus of claim 1, further comprising:

a plurality of motion sensors configured to detect whether there is a person within a certain range from a position of each of the plurality of dampers; and a stepping motor provided to each of the plurality of dampers, and configured to adjust the opening degree, wherein the processor is further configured to control open/closed states of the plurality of dampers in accordance with a detection result from the plurality of motion sensors by controlling a plurality of the stepping motors.

4. The air-conditioning apparatus of claim 1, wherein when $Q\alpha\mathbf{0}$ is an air flow rate when Nset number of the plurality of dampers are in the open state, and $Q\alpha k$ is the reference air flow rate when Nk number of the plurality of dampers are in the open state, the memory stores a value calculated by the formula $Q\alpha k = Q\alpha\mathbf{0} \times Nk/Nset$, and the processor calculates the reference air flow rate $Q\alpha k$ in accordance with the formula when determining that Nk, being the number of the plurality of dampers in the open state, has changed based on the detection value of the opening/closing sensor, and updates the reference air flow rate $Q\alpha k$ to the reference air flow rate $Q\alpha k$ stored by the memory.

5. An air-conditioning apparatus comprising:

a fan configured to send air to an air-conditioned space;

a fan motor configured to drive the fan;

a duct having a plurality of air outlets, the air sent by the fan flowing through the duct;

a detection unit including an ammeter configured to detect an air flow rate of the fan;

a damper provided to each of the plurality of air outlets;

an opening/closing sensor provided to each of the plurality of dampers, and configured to detect an opening degree of the damper;

a processor configured to execute processes in accordance with a program; and a memory configured to store the program, the memory being configured to store static pressure relationship information showing a relationship among static pressure of the fan, the air flow rate, and a rotation speed of the fan motor, and a reference air flow rate corresponding to the opening degree to be set for each of the dampers; and the processor being configured to obtain a rotation speed of the fan motor that makes the air flow rate constant by changing the reference air flow rate based on the static pressure relationship information stored by the memory upon a variation in an opening degree of the plurality of dampers detected by the plurality of the opening/closing sensors, and control a rotation speed of the fan motor such that the rotation speed of the fan motor corresponds to the rotation speed of the fan motor obtained by the processor relative to a variation in the opening degree of the damper of the plurality of dampers, wherein when $Q\alpha\mathbf{0}$ is an air flow rate when Nset number of the plurality of dampers are in the open state, and $Q\alpha k$ is the reference air flow rate when Nk number of the plurality of dampers are in the open state, (i) the memory stores a value calculated by the formula $Q\alpha k = Q\alpha\mathbf{0} \times Nk/Nset$, and (ii) the processor calculates the reference air flow rate $Q\alpha k$ in accordance with the formula when determining that Nk, being the number of the plurality of dampers in the open state, has changed based on the detection value of the opening/closing sensor, and updates the reference air flow rate $Q\alpha k$ to the reference air flow rate $Q\alpha k$ stored by the memory.

6. The air-conditioning apparatus of claim 5, wherein the detection unit is an air flow sensor provided to the duct to detect the air flow rate.

7. The air-conditioning apparatus of claim 5, further comprising:

a plurality of motion sensors configured to detect whether there is a person within a certain range from a position of each of the plurality of dampers; and a stepping motor provided to each of the plurality of dampers, and configured to adjust the opening degree, wherein the processor is further configured to control open/closed states of the plurality of dampers in accordance with a detection result from the plurality of motion sensors by controlling a plurality of the stepping motors.

* * * * *